United States Patent [19]

Renfroe, Jr. et al.

[11] Patent Number: 4,632,184

[45] Date of Patent: Dec. 30, 1986

[54] SUBMERSIBLE PUMP SAFETY SYSTEMS

[75] Inventors: James B. Renfroe, Jr., Valencia, Calif.; Rennie L. Dickson, Carrollton; Roger D. Rion, The Colony, both of Tex.

[73] Assignee: Otis Engineering Corporation, Carrollton, Tex.

[21] Appl. No.: 789,724

[22] Filed: Oct. 21, 1985

[51] Int. Cl.[4] ..... E21B 43/12

[52] U.S. Cl. ..... 166/105.5; 166/106; 166/188; 166/321

[58] Field of Search ..... 166/105.5, 106, 105, 166/133, 188, 321, 324, 322, 332

[56] References Cited

U.S. PATENT DOCUMENTS

| | | | |
|---|---|---|---|
| 3,782,461 | 1/1974 | Watkins | 166/72 |
| 3,845,818 | 11/1974 | Deaton | 166/322 |
| 3,861,464 | 1/1975 | Boyadjieff et al. | 166/72 |
| 4,103,744 | 8/1978 | Akkerman | 166/324 |
| 4,354,554 | 10/1982 | Calhoun et al. | 166/321 |
| 4,461,353 | 7/1984 | Vinzant et al. | 166/322 |
| 4,502,536 | 3/1985 | Setterberg, Jr. | 166/105.5 |
| 4,589,482 | 5/1986 | Bayh, III | 166/105.5 |

*Primary Examiner*—James A. Leppink
*Assistant Examiner*—Hoang C. Dang
*Attorney, Agent, or Firm*—Vinson & Elkins

[57] ABSTRACT

A pump produces through a tubing in a cased well. Gas is vented through the packer and through a valve preferably located in a side pocket mandrel in the tubing. A subsurface safety valve is positioned in the tubing below the side pocket mandrel and preferably below the packer. The safety valve is preferably of the flapper type and when the valve is closed liquid is automatically recirculated to the pump.

6 Claims, 7 Drawing Figures

SUBMERSIBLE PUMP SAFETY SYSTEMS

Figure 1:
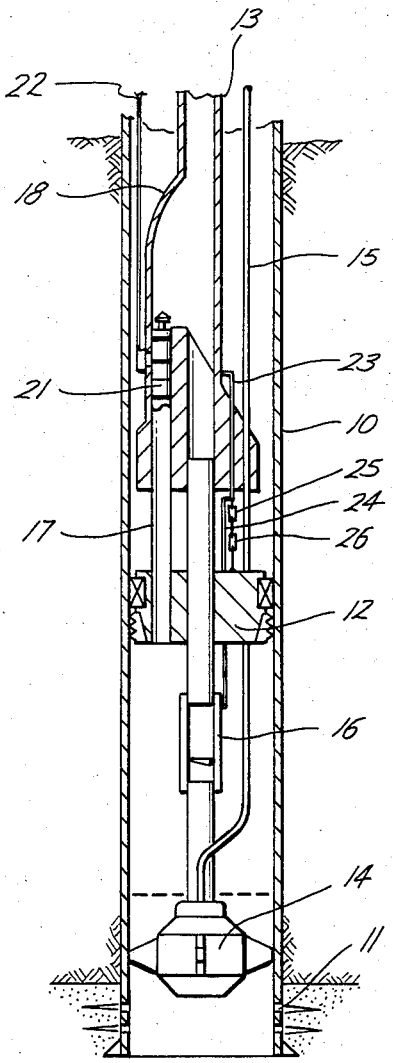

This invention relates to submersible pump safety systems and more particularly to systems which provide for recirculation of pumped fluid when the subsurface safety valve is closed and in which substantially standard components are used in the system.

Safety systems have been utilized in the past which provide for recirculation of pumped fluid when the subsurface safety valve is closed. These systems have all employed relatively complicated valving and while they are acceptable for the purpose of the system, they are relatively expensive and each have some disadvantage.

The Calhoun U.S. Pat. No. 4,354,554 for instance employs an annular valve for gas control and the tubing normally must be pulled for service of this valve. The subsurface safety valve utilizes a depending tailpipe which controls recirculation of pumped fluid when the safety valve is closed. As the actuator above the ball valve member of Calhoun is attached to the tailpipe extending down to the recirculation valve a complex structure is taught.

Setterberg U.S. Pat. No. 4,502,536 taught to integrate the recirculation with the packer by using an (H) type crossover associated with the packer. In one illustrated form the crossover was integrated with the gas control valve resulting in a relatively complex design. In the other illustrated form three separate valves are utilized, one to control gas, one providing the safety valve in the tubing, and the third controlling the crossover.

Vinzant U.S. Pat. No. 4,461,353 also utilized the (H) type crossover in conjunction with a packer and a ball type valve which travelled between two seats and cooperated with one seat when the ball is in open position to prevent flow through the crossover for recirculation and with a second seat when the ball is closed to close the valve while opening the recirculation ports. This double seated valve again is a relatively complex, expensive structure.

It is an object of this invention to provide a simple, efficient valve means for controlling flow from the output of a pump which alternately directs flow to the surface and recirculates flow through the pump.

Another object is to provide a flapper type safety valve with provision for circulation below the flapper valve member when the flapper valve member is in closed position and automatically sealing off the recirculation feature when the flapper valve member is in open position.

Another object is to provide a production system for a well employing a submerged pump in which a simple safety valve may be located below a vent valve in a mandrel in the tubing to permit wireline servicing of the vent valve without penetrating the safety valve.

Another object is to provide a production system for a well employing a submerged pump in which the safety valve may be located below the packer and when closed, the valve recirculates pumped fluid directly into the well annulus below the packer.

Another object is to provide a production system for a well employing a submersible pump in which a simple flapper valve may be located below the packer and when the flapper valve is closed, ports are open for recirculation directly into the well annulus and when the flapper valve is open the ports are automatically closed.

Another object is to provide a system as in the preceding object wherein the vent valve is a retrievable valve located in a side pocket mandrel in the tubing above the safety valve.

Another object is to provide a production system for a well employing a submerged pump in which the safety valve may be located below the packer.

Another object is to provide a safety system for a well employing a submerged pump in which a vent valve is landed in a side pocket mandrel carried by the tubing immediately above the packer and connected with a tailpipe extending through the packer and a subsurface safety valve is provided below the packer wherein the subsurface safety valve, the packer, the side pocket mandrel and vent valve in the mandrel, are all substantially standard items of equipment with slight, relatively inexpensive modifications to equip them for the system.

Figures 2A, 3A:
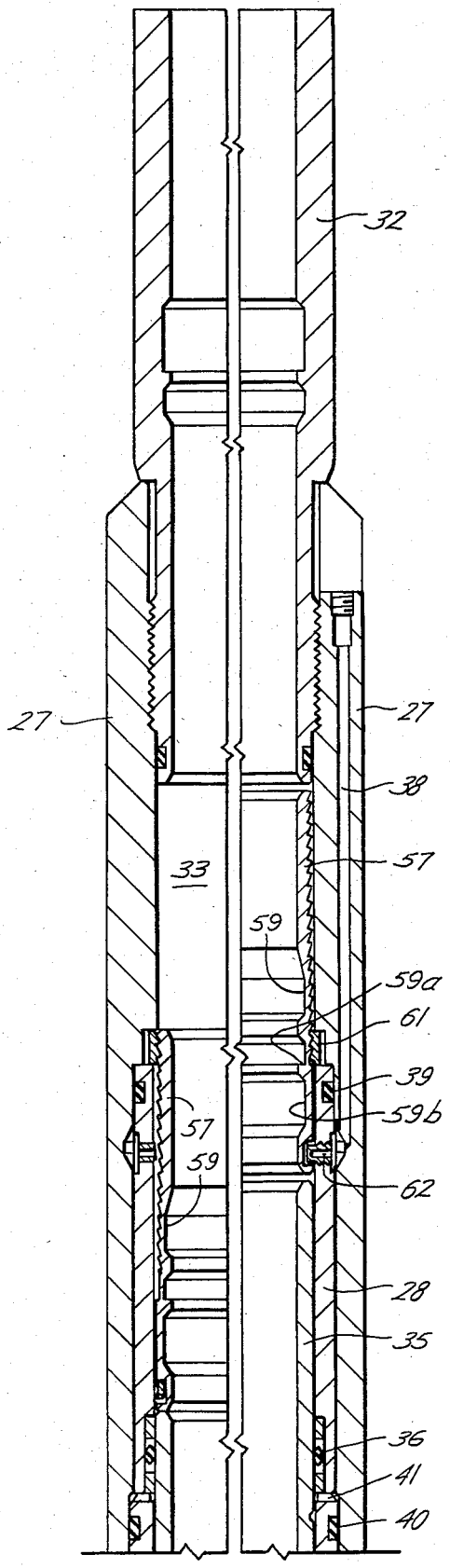
Figure 2B:
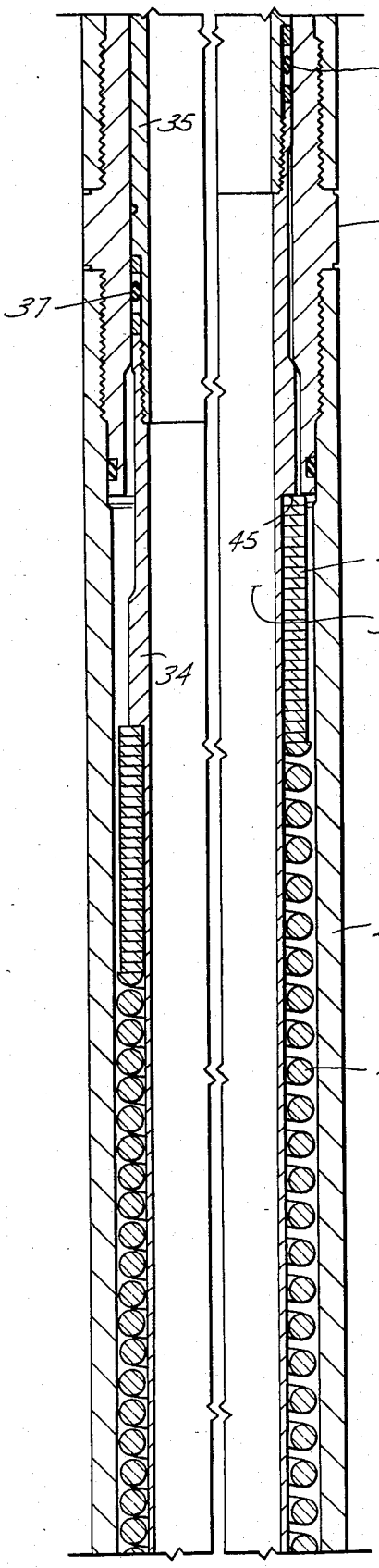
Figure 3B:
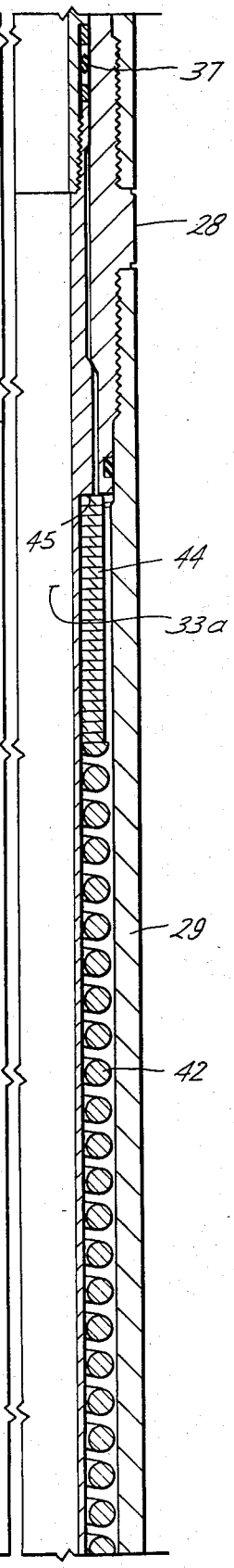
Figure 2C:
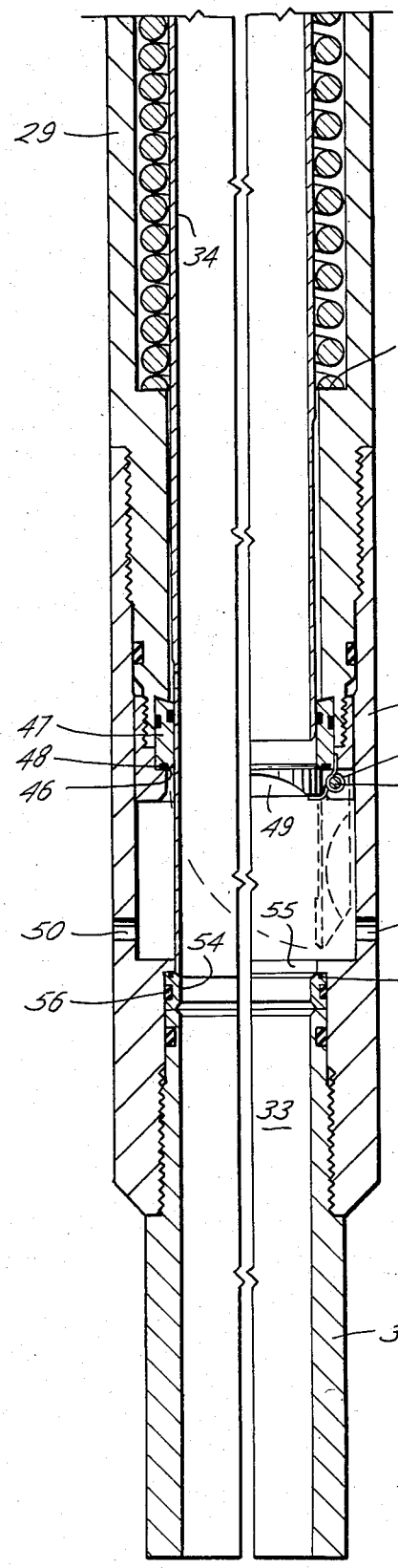
Figure 3C:
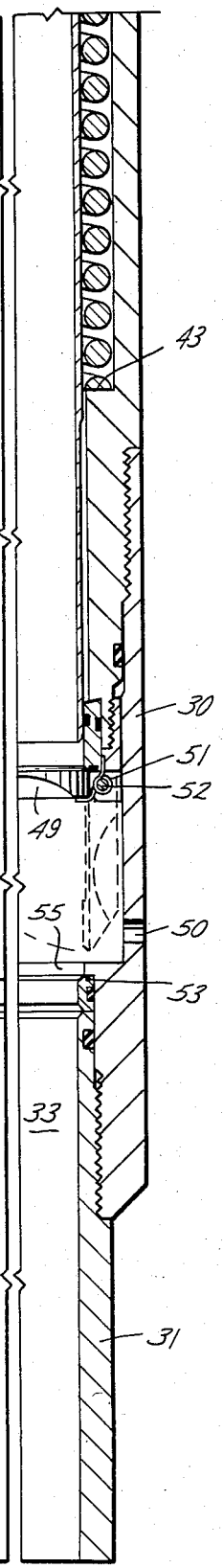

In the drawings wherein an illustrative embodiment of this invention is shown and wherein like reference numerals indicate like parts, FIG. 1 is a schematic illustration of the production system of this invention;

FIGS. 2A, 2B and 2C are continuation sectional views of a preferred form of safety valve with the main flapper valve in open position, the recirculating valve in closed position and the lockout sleeve in its lower operative position; and FIGS. 3A, 3B and 3C are views similar to FIG. 2 with the main flapper valve shown in closed position and the recirculating valve in open position.

The system illustrated in FIG. 1 includes the casing 10 perforated at 11 at the producing formation. A substantially conventional packer 12 packs off the well annulus above the formation. A tubing 13 extends through the packer 12.

A submerged pump 14 of conventional design is positioned on the lower end of the tubing for pumping liquids from the formation 11 through the tubing to the surface in a conventional manner. Power for pump 14 is provided through power line 15 such as an electrical cable which extends through the packer 12.

Also provided in the tubing is the subsurface safety valve 16 which preferably is of the design shown in FIG. 2. While this valve is shown to be positioned below the packer it could be positioned above the packer by connecting the recirculation ports of the subsurface safety valve to the annulus below the packer; as for instance, by connecting the recirculation ports to the tailpipe 17 which extends upwardly from the packer. In accordance with this invention, however, it is preferred that the subsurface safety valve 16 be positioned below the packer and that the recirculation discharge from the subsurface safety valve communicate directly with the well annulus.

A side pocket mandrel 18 is provided in tubing 13. This mandrel could be located above or below the packer 12 by suitably communicating the mandrel with the flowway through the packer. It is preferred to position the mandrel above the packer and connect the mandrel pocket to the vent gas flowway through the packer 12 by the tailpipe 17. In the event the mandrel is positioned below the packer the side ports in the mandrel would be connected to the flowway through the packer. The upper position of the mandrel illustrated is preferred as this permits the use of a substantially conventional side pocket mandrel.

Positioned within the valve bore of the side pocket mandrel is the gas control vent valve 21 which may be of conventional design or may be specially designed for acoustic sounding.

The system is suitably controlled by pressure fluid from the surface. Preferably, a single pressure fluid control line 22 extends from a source of pressure at the surface to the vent valve 21. A branch control line 23 extends downwardly to the packer 12 where it is desired to utilize control pressure to set the packer 12 in the well-known manner. This branch line may include relief valve 25 and check valve 26. A branch line 24 extends to the safety valve 16 to control this valve.

As will more fully appear in the description of the preferred form of safety valve shown in FIG. 2, recirculation provisions are made in the safety valve which when the safety valve is closed, directs pumped fluid to the well annulus.

In running the system the several components are made up in the conventional manner at the surface and run into the well with the pump located at the bottom of the tubing and the safety valve 16 made up at any desired level, preferably below the packer. The packer and side pocket mandrel 18 are made up as a single stand or assembly. After the system has been run the packer may be set in the conventional manner as by employing a hydraulic packer set by fluid from the control line 22. After the packer has been set, release of pressure in the control line 22 permits the check valve 26 to close maintaining the desired hydraulic pressure in the packer.

During normal production of the well, pressure is maintained in the control line 22 which maintains the vent valve 21 and the subsurface safety valve 16 in the open condition for flow of liquids up the tubing 13 and gas through the tailpipe 17.

The well may be shut in at any time by relieving pressure in control line 22 which results in closing of the vent valve 21 by its conventional closing spring and closing of the subsurface safety valve 16 by its closing spring as shown in FIG. 2. The vent valve 21 may take any construction desired and conventionally employs a pressure responsive piston for moving the valve to open position and a resilient means such as a spring for returning the vent valve to closed position. The side pocket mandrel and vent valve may be designed in a known manner to facilitate acoustical sounding of the liquid level within the well through the side pocket mandrel vent valve and tailpipe 17.

Referring now to FIGS. 2A, 2B, 2C, 3A, 3B, and 3C, a preferred form of safety valve which may be utilized as the valve 16 in the system of FIG. 1 is shown. This valve has a tubular body means provided by an upper sub 27, a piston housing 28, a spring housing 29, and a lower seat retainer, the upper portion of which is shown at 31.

A landing nipple, whose lower portion is shown at 32, is connected to upper sub 27 and may also be considered a part of the housing if it is specially designed to cooperate therewith as is the case in the illustrated form of valve.

The body has a flowway means 33 which extends longitudinally through the body in the conventional manner.

A tubular valve actuator 34 is slidably telescoped within and reciprocates longitudinally in the body. The bore through the actuator 34 provides the portion **33*a*** of the flowway through the body.

A piston means provided by the actuator piston 35 forms a part of and is carried by the actuator means. This piston has a sliding seal with the body means provided by the upper piston seal 36 and the relatively larger lower piston seal 37.

The piston means 35 is responsive to control fluid pressure for moving the actuator means 34 in a downward direction. Control fluid pressure is provided by a conduit secured to the control fluid passageway 38 which communicates at its lower end with the annulus between the upper sub 27 and the piston housing 28. Upper and lower housing seals 39 and 40 confine control pressure to this annulus and to the pressure chamber 41 between the piston seals 36 and 37. Thus, the application of fluid pressure to passageway 38 and chamber 41 results in driving the piston 35 and its associated actuator 34 downwardly to control flow through the valve.

Resilient means 42 is provided to drive the actuator 34 upwardly when the strength of the resilient means is sufficient to overcome the pressure conditions acting downwardly on the actuator piston 35. This resilient means 42 is held in compression between an upwardly facing shoulder 43 in the spring housing 29 and spacers 44 which extend between the resilient means 42 and a downwardly facing shoulder 45 on the actuator. Upward movement of the actuator in response to the force of the spring is limited by the spacers engaging the lower end of the piston housing 28.

At the lower end of the valve a main valve seat means 46 carried by the seat insert 47 surrounds the passageway means 33. This main valve seat may include an insert 48 of suitable sealing material. As best seen in FIG. 3C, the valve seat 46 is positioned below the lower end of the actuator 33 when the resilient means is extended and the spacers 44 engage the lower end of the piston housing 28.

A flapper valve means 49 is located in the path of the actuator means and engageable with the main valve seat means 46 to control flow through the passageway means 33 at the valve seat 46. This flapper valve 49 is urged toward closed position by spring 51 wrapped around the pivot 52 for the flapper member 49.

Port means 50 are provided in the body means below said main valve seat means 46 and provide a flow path between the flowway means 33 and the exterior of the body means when said flapper valve is in engagement with said main valve seat means 46. Thus, when the valve is employed in the system of FIG. 1 and the flapper valve is in its closed position, these ports 50 communicate the flowway within the valve below the seat 46 with the exterior of the valve housing and permit liquids to recirculate from the flowway through the ports to the annulus and return to the pump.

An actuator seat means 53 is carried by the upper end of a ring seat carrier 54. This ring seat carrier is held against the shoulder provided by a counter bore 55 in the lower sub 30 by the lower seat retainer 31. The ring seat carrier 54 has an external seal 56 to prevent fluid washing past the exterior of the ring seal.

The actuator seat 53 may take any desired form and in the illustrated embodiment is a ring of sealing material carried by the upper end of the ring seat carrier 54 and engageable with the lower end of the actuator when the actuator is in its full down position as best seen in FIG. 2C. In this position, the upper end of the ring seat carrier 54 acts as a stop for the actuator with its lower end in engagement with the actuator seat 53 about the outer periphery of the lower end of the actuator 34. It will be appreciated that any desired form of seal could be provided between the actuator and the lower end of the housing at a position below the ports 50.

A lockout sleeve 57 is slidably telescoped within the upper sub 27 above the upper end of the actuator piston 55 when in its upper position shown in FIG. 3A. The lockout sleeve 57 carries the conventional internal selector and landing grooves 59, 59A and 59B for receiving the keys of an actuator tool. A lockout ring 61 surrounds the lockout sleeve and suitable conventional ratchet surfaces are provided on the exterior of the lockout sleeve and on the interior of the lockout ring 61.

The lockout sleeve is held in its upper inoperative position by a shear lug 62.

The ports 50 may be closed by conventional plugs, not shown, so that the valve illustrated in FIGS. 2 and 3 may be utilized as a conventional subsurface safety control valve without the provision for recirculation. It is noted that the valve illustrated is substantially conventional except that the lower sub 30 has provision for the ports 50 and the seat 53 to be engaged by the actuator 34. These items may be added to a conventional flapper type valve as will be apparent to those skilled in the art.

In operation, the valve is made up in the system shown in FIG. 1 and the surface control line 22 is connected to the passageway 38. When control line 22 is pressurized the pressure within the chamber 41 drives the piston 35 downwardly and moves the actuator to the main valve open position shown in FIGS. 2A through 2C. At this time, the actuator seals with the actuator seat 53 and recirculation is prevented. All output from the pump 14 flows upwardly to the tubing 13 to the surface.

When the pressure is relieved in the control line 22 the resilient means 42 returns the actuator 34 to the up position shown in FIGS. 3A through 3C permitting the flapper 49 to be moved into engagement with its seat 46 by the spring 51 and by the differential in pressure thereacross. At this time, the ports 50 are uncovered as shown in FIGS. 3C and if the pump 14 continues to run fluid is recirculated from the lower end of the flowway 33 through the ports 50 to the annulus below the packer to return to the pump and prevent damage to the pump which might occur if the pump ran dry.

When it is desired to lock the valve open, a shifting tool is landed in sleeve 57 and the sleeve shifted downward to its FIG. 2A position. The ring 61 locks the valve in main valve open position.

An auxiliary valve may then be landed in the nipple 32 with seals between the valve, and landing nipple and actuator 34. Control pressure through the port in shear lug 62 will then control the auxiliary valve.

It will be noted that all of the components of the system are conventional or substantially conventional. Thus, costs of equipment is reduced. Also, as the system is made up of conventional items, their reliability is assured.

The foregoing disclosure and description of the invention are illustrative and explanatory thereof and various changes in the size, shape and materials, as well as in the details of the illustrated construction, and various changes in the process, may be made within the scope of the appended claims without departing from the spirit of the invention.

I claim:

1. A production system for a petroleum well comprising:

well packer means;

vent passageway means through said packer means;

vent valve means responsive to control fluid pressure and controlling flow through said vent passageway means;

tubing means extending through said packer means;

a safety valve in the tubing comprising, tubular body means, flowway means through the body means, tubular valve actuator means slidably telescoped in the body means and providing a part of said flowway means, piston means carried by said actuator means and having a sliding seal with said body means and responsive to control fluid pressure for moving said actuator means in a downward direction, resilient means urging said actuator means in an upward direction, main valve seat means surrounding said passageway means and positioned below the lower end of said actuator means when said resilient means is extended, flapper valve means in the path of said actuator means and engageable with said main valve seat means to control flow through said passageway means, port means in the body means below said main valve seat means providing a flowpath between the flowway means and the exterior of the body means when said flapper valve means is in engagement with said main valve seat means, actuator seat means below said port means engaged by said actuator means when said actuator means is in its full valve open position responsive to control fluid pressure, and seal means carried by one of said actuator seat means and said actuator means for sealing therebetween when said actuator means engages said actuator seat means to prevent flow through said port means; and pump means in the tubing below said safety valve.

2. The system of claim 1 wherein said safety valve is positioned between said packer means and said pump means.

3. The system of claim 2 wherein side pocket mandrel means is provided in said tubing means above said safety valve, and said vent valve means is a retrievable valve located in said side pocket mandrel means.

4. The system of claim 1 wherein side pocket mandrel means is provided in said tubing means above said safety valve, and said vent valve means is a retrievable valve located in said side pocket mandrel means.

5. A production system for a petroleum well comprising:

well packer means, vent passageway means through said packer means, vent valve means responsive to control fluid pressure and controlling flow through said vent passageway means, tubing means extending through said packer means, pump means in said tubing means, safety valve means in said tubing means between said packer means and said pump means and responsive to said control fluid pressure to alternately direct flow from said pump means upwardly through said tubing means and to the exterior of said tubing means for return to said pump means.

6. The system of claim 5 wherein:

a side pocket mandrel means is located in said tubing means above said packer means, and said vent valve means is mounted in said side pocket means.

* * * * *